United States Patent [19]

Chen

[11] 4,318,546

[45] Mar. 9, 1982

[54] GOLF CLUB SWING TRAINING DEVICE

[75] Inventor: Chin S. Chen, Taipei, Taiwan

[73] Assignee: Chien Chung Chen, Japan

[21] Appl. No.: 244,039

[22] Filed: Mar. 16, 1981

[30] Foreign Application Priority Data

Jan. 27, 1981 [JP] Japan ..... 56-10467

[51] Int. Cl.[3] ..... A63B 69/36

[52] U.S. Cl. ..... 273/188 R

[58] Field of Search ..... 273/188 R, 188 A, 189 R, 273/189 A, 190 R, 183 B, 26 R

[56] References Cited

U.S. PATENT DOCUMENTS 1,530,519 3/1925 Remington ..... 273/188 R
2,469,301 5/1949 Johnston ..... 273/188 R
2,611,610 9/1952 Hara ..... 273/190 R X
3,138,388 6/1964 Herold ..... 273/188 R X

*Primary Examiner*—George J. Marlo
*Attorney, Agent, or Firm*—John C. Malloy

[57] ABSTRACT

Golf club swing training apparatus includes an upwardly extending support consisting of a fixed lower part and a forwardly-tiltable upper part, and a back holding member, adjustable in length and a waist holding member which members are each rotatably mounted on the upper part at a mid portion thereof for turning motion about the axis of said upper part. A strap is provided at the ends of each holding member for attaching the back holding member to the upper part of the golfer's arms and the waist holding member to the golfer's waist.

7 Claims, 4 Drawing Figures

GOLF CLUB SWING TRAINING DEVICE

This invention relates to a golf-swing correcting apparatus of a simple construction.

In order to attain a stable and powerful shot in golfing, it is essential for a golfer to always follow a fixed, constant swing path throughout the entire stroke of a swing from the take back to the follow through with the waist or shoulders of the golfer being moved in an upward or downward direction or in a leftward or rightward direction as little as possible and without the axis of the backbone of the golfer being moved in a forward or backward direction or in a leftward or rightward direction.

The present invention thus relates to a golf-swing correcting apparatus of a simple construction which enables a golfer to always follow a fixed, constant swing path by constituting same such that the shoulders and waist of a practitioner or user of the apparatus are guided or restricted to always turn around a substantially fixed axis almost without being permitted to move in an upward or downward direction or in a leftward or rightward direction all through a swinging action from the take back to the follow through.

This invention will now be described in more detail in reference to a preferred embodiment illustrated in the accompanying drawings, in which.

Figure 1:
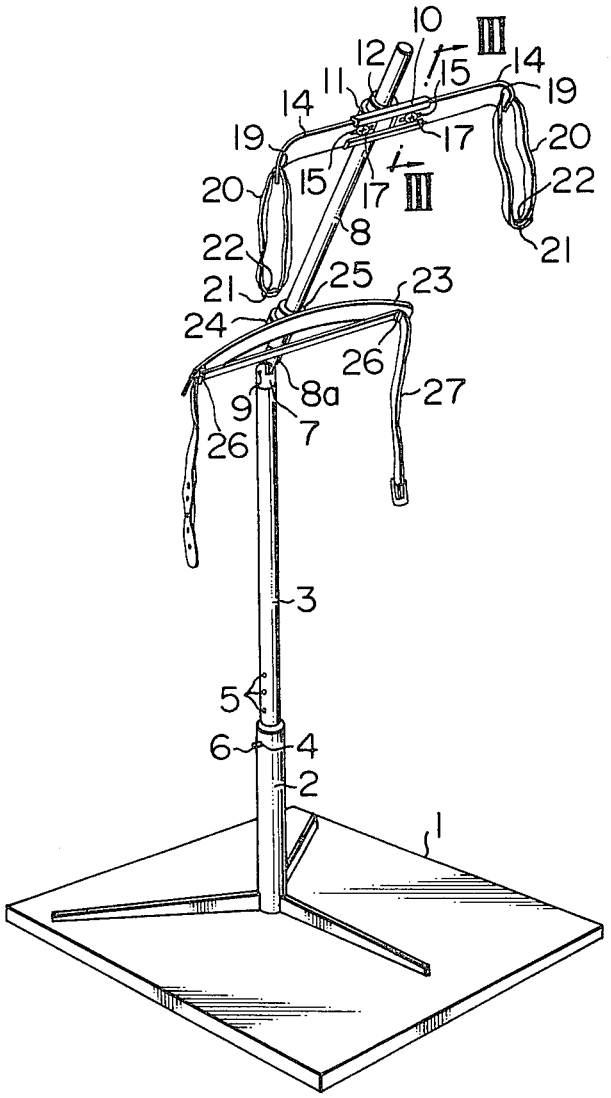
FIG. 1 is a perspective view of a golf-swing correcting apparatus embodying the present invention, seen from the front.
Figure 2:
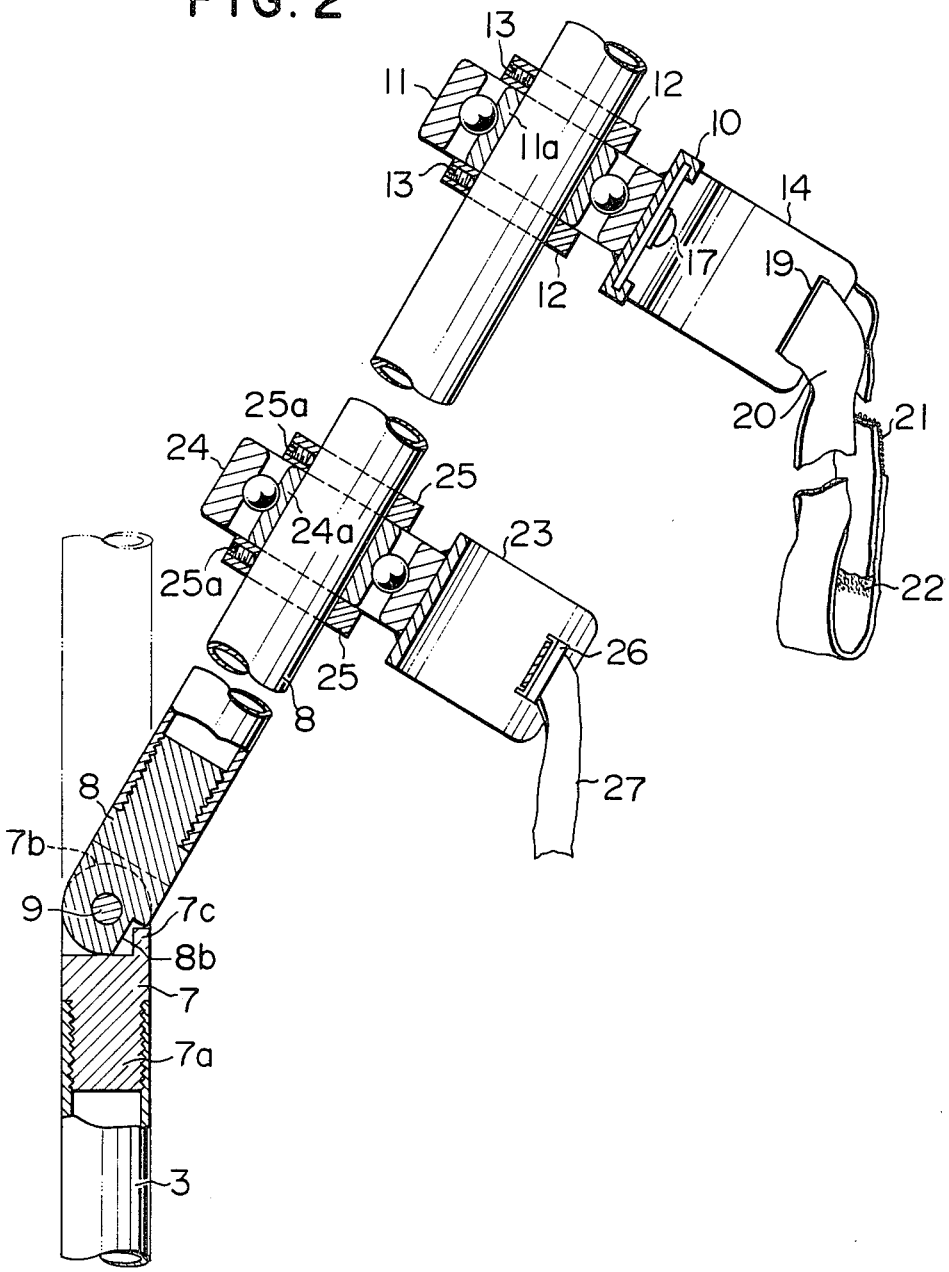
FIG. 2 is a fragmentary enlarged sectional view of the apparatus of FIG. 1 taken along a plane which contains the axes of a fixed lower support and a tiltable upper support of the apparatus.
Figure 3:
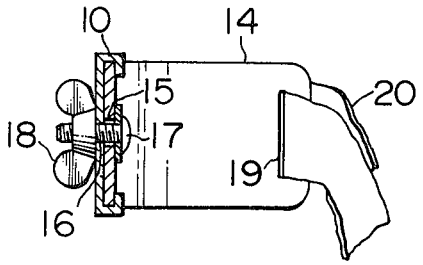
FIG. 3 is an enlarged sectional view taken along line III—III of FIG. 1.
Figure 4:
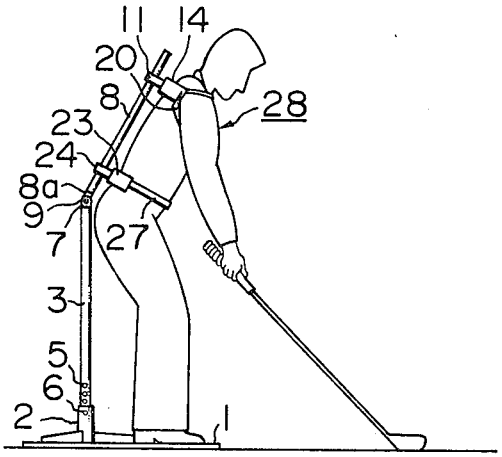
FIG. 4 is a side elevational view, showing the golf-swing correcting apparatus in use.

As is illustrated in FIG. 1 which shows an embodiment of a golf-swing correcting apparatus according to the present invention, the apparatus includes a base plate 1 having a support cylinder 2 mounted uprightly at the center of a rear portion of the base plate 1. The support cylinder 2 receives therein a lower end portion of a fixed vertical support 3 in the form of a pipe so as to mount the fixed support 3 uprightly thereon. The support cylinder 2 defines a through-hole 4 formed to extend in a diametrical direction through the wall of a top portion thereof, and the fixed support 3 has a plurality of adjustment holes 5 formed to extend in a diametrical direction through a lower portion thereof along a line parallel to the axis thereof. Thus, the fixed support 3 is adjustably fixed to the support cylinder 2 at a desired height by means of a horizontal pin 6 which is inserted in and extended through the hole 4 of the support cylinder 2 and one of the adjustment holes 5 of the fixed support 3.

A lower cylindrical portion **7*a* of a pivotal support member 7 is fitted in the fixed support 3 at the top end thereof. The pivotal support member 7 has at the top thereof a pair of pivotal support projections 7*b* formed in parallel relationship to define a groove therebetween. An abutment or stop 7*c* is formed forwardly of the groove between the pivotal support projections 7*b***.

Properly accommodated in the groove between the pivotal support projections **7*b* of the pivotal support member 7 is a connecting section formed to extend downwardly from the center of the lower end of a connecting member 8*a* which is fitted in the lower end of a tiltable support 8 in the form of a pipe. The pivotal support member 7 and the connecting member 8*a* are pivotally connected to each other by means of a horizontal connecting pin 9** extended therethrough.

In the lower front end of the connecting member **8*a* is formed a recess 8*b* which corresponds to the aforementioned stop 7*c* of the pivotal support member 7 such that tilting motion of the tiltable support 8 is limited preferably to a range between the vertical position and another position forwardly tilted or inclined at an angle of depression of 30 degrees by an abutment of the stop 7*c* of the pivotal support member 7 with the top and rear walls of the recess 8*b* of the connecting member 8*a***.

In use of the swing correcting apparatus, the pivotal connection by means of the horizontal connecting pin 9 may preferably be adjusted to or rather lower than the height of the waist of a practitioner or user of the apparatus by a selective insertion of the horizontal pin 6 into the adjustment holes 5 of the fixed support 3.

A shoulder holding device is attached to the top end portion of the tiltable support 8. The shoulder holding device includes a fixing plate 10 extending in the horizontal leftward and rightward directions and having a cross section which defines a forwardly opened channel. The fixing plate 10 is attached to the top end portion of the tiltable support 8 by means of a ball bearing 11. The ball bearing 11 is secured to the center of the rear face of the fixing plate 10 and has its inner race **11*a* securedly fitted on the tiltable support 8. The upper and lower faces of the inner race 11*a* is held in place by means of retention rings 12 fitted on the tiltable support 8. Each numeral 13 indicates a fastening screw 13 for fixedly securing its respective ring 12**.

Accommodated in the channel of the fixing plate 10 at opposite ends thereof are a pair of slide plates 14 each having an outer free end thereof curved in the forward direction. Each slide plate 14 has a horizontally elongated hole 15 formed through its proximal end portion, and the fixing plate 10 has a pair of holes 16 formed at opposite ends thereof. Thus, each slide plate 14 can be adjustably secured to the fixing plate 10 by means of a bolt 17, which is extended through the elongated hole 16 of the fixing plate 10 and a butterfly nut 18 cooperative with the bolt 17 for fastening the two plates 10 and 14 together. Thus, it may be easily seen that both slide plates 14 can be adjustably secured to the fixing plate 10 in accordance with the width of the shoulders of a practitioner or user of the apparatus.

Each slide plate 14 has a vertically elongated hole 19 formed in the distal free end thereof. Each upper arm holding strap 20 for holding its corresponding upper arm of a practitioner is made of a band and is loosely extended through the elongated hole 19 of its repective slide plate 14. Each holding strap 20 has a mutually engageable hook member 21 and loop member 22 of a hook and loop type fastener applied to opposite ends thereof.

A waist holding member 23 is provided at a lower portion of the tiltable support 8 and extends in the horizontal leftward and rightward directions. The waist holding member 23 has its opposite end portions curved forwardly such that the rear face of the waist of a practitioner can be comfortably received by the curved waist holding member 23. The waist holding member 23 is attached to the tiltable support 8 by means of a ball bearing 24 which is secured to the center of the rear face of the waist holding member 23 and has its inner race 24*a* securedly fitted on the tiltable support 8. The upper and lower faces of the inner race 24*a* is held in place by means of retention ring 25 each fitted on the tiltable support 8. Indicated at each numeral 25*a* is a fastening screw for fixedly securing its corresponding ring 25 on the support 8.

A band 27 is extended through a pair of band guides 26 provided at opposite ends of the waist holding member 23 on the front face thereof.

In using a swing correcting apparatus of the present invention having the above-described construction, a practitioner or user 28 of the apparatus first stands at the center of a forward portion of the base plate 1 with the rear face of the waist received in the curved waist holding member 23 and then the waist is properly tied to the waist holding member 23 with the band 25. Both left and right upper arms of the practitioner 28 are then suitably tied at the root portions thereof to the shoulder holding device with the upper arm holding straps 20. In these conditions, the practitioner may perform a swing of a club in a normal way.

During such a swing, the slide plates 14 and the waist holding member 23 which respectively restrain both upper arms and the waist of the practitioner are only permitted to turn about the forwardly tilted or inclined support 8 which is positioned a little distance behind and extends in parallel with the backbone of the practitioner while they are restricted from moving in the leftward or rightward direction. Accordingly, the swing correcting apparatus can provide ideal turning of the shoulders and waist of the practitioner about the tiltable support 8.

Consequently, the practitioner is prevented from assuming an irregular or bad posture and thus the club head will naturally follow an ideal swing path. And particularly, just at the moment of a shot at a ball by the practitioner with the body correctly opposed to the ball, the backbone is positioned just in front of the tiltable support 8 without being permitted to move or tilt in the leftward or rightward directon so that the practitioner can perform a proper and powerful shot at a ball.

It is to be noted that, while the tiltable support 8 is pivotally or tiltably supported on the fixed support 3 by means of a horizontal connecting pin 9 extending in the leftward and rightward directions, the tiltable support 8 will not be pivoted upwardly at any time when the body of the practitioner is directed even a little bit sidewardly from the front during a swing, that is, at any time except when addressing for the swing, even if the practitioner should try to raise the upper part of the body since an oblique or laterally inclined upward force will act upon the pivotal support projections 7*b* of the pivotal support member 7 and the connecting member 8*a* of the tiltable support 8. As a result, upward movement of the body of the practitioner can be prevented.

When tired with practice, the practitioner can straighten himself or herself to take a rest by facing the front and raising the upper part of the body, allowing the tiltable support 8 to be pivoted upwardly about the horizontal connecting pin 9.

According to the golf-swing correcting apparatus of the present invention, correction of the posture of the body during a swing motion can be easily attained while such a correction has been difficult to attain so far, and hence an ideal turn of the club head can be naturally attained thereby. The golf-swing correcting apparatus of the invention is thus remarkably useful for an efficient practice of golf.

What is claimed is:

1. A golf-swing correcting apparatus, comprising: a support having a lower part and an upper part tiltable in the forward direction relative to said lower part; a back holding member mounted at a mid portion thereof on said upper part for turning motion about the axis of said upper part and extending in a horizontal direction, said back holding member adapted to be positioned at a height substantially corresponding to the shoulders of a given practitioner; a pair of straps provided on opposite horizontal ends of said back holding member adapted for holding respectively the upper right and left arms of the practitioner; a waist holding member mounted at a mid portion thereof on said upper part for turning motion about the axis of said upper part and extending in a horizontal direction, said waist holding member adapted to be positioned at a height substantially corresponding to the waist of the practitioner; and a belt provided on said waist holding member adapted for tieing the waist of the practitioner to said waist holding member.

2. A golf-swing correcting apparatus as claimed in claim 1, further comprising a base plate having said support uprightly mounted thereon.

3. A golf-swing correcting apparatus as claimed in claim 2, wherein said forwardly tiltable upper part of said support is pivotally supported at the top end of said lower part which is fixed and extends in the vertical direction.

4. A golf-swing correcting apparatus as claimed in claim 3, wherein the angle of depression of said tiltable upper part is limited approximately to 30 degrees by means of a stop.

5. A golf-swing correcting apparatus as claimed in claim 4, further comprising means provided at a suitable portion of said fixed lower part for enabling an adjustment of the height of said fixed lower part.

6. A golf-swing correcting apparatus as claimed in claim 5, wherein said back holding member is adjustable in the horizontal length thereof.

7. A golf-swing correcting apparatus as claimed in claim 6, wherein each of said straps is made of a band opposite free ends of which are connectable to each other by means of a hook and loop type fastener.

* * * * *